US008047211B2

(12) United States Patent
Gladwin et al.

(10) Patent No.: US 8,047,211 B2
(45) Date of Patent: Nov. 1, 2011

(54) HAIR CLIP

(76) Inventors: Thea Gladwin, Randburg (ZA); Richard George Gladwin, Randburg (ZA)

( * ) Notice: Subject to any disclaimer, the term of this patent is extended or adjusted under 35 U.S.C. 154(b) by 474 days.

(21) Appl. No.: 12/092,955

(22) PCT Filed: Nov. 2, 2006

(86) PCT No.: PCT/ZA2006/000126

§ 371 (c)(1),
(2), (4) Date: May 29, 2008

(87) PCT Pub. No.: WO2007/053861

PCT Pub. Date: May 10, 2007

(65) Prior Publication Data

US 2008/0283074 A1 Nov. 20, 2008

(30) Foreign Application Priority Data

Nov. 7, 2005 (ZA) ..... 2005/08995

(51) Int. Cl.
*A45D 24/04* (2006.01)
*A45D 8/12* (2006.01)

(52) U.S. Cl. ..... 132/126; 132/128; 132/275

(58) Field of Classification Search ..... 132/126, 132/128, 130, 131, 132, 133, 134, 138, 139, 132/141, 142, 144, 148, 212, 219, 273, 275, 132/276, 278, 277, 274, 279, 61, 63.1, 64.1, 132/65.1; D28/21, 29, 32, 34, 41, 43; 24/499, 24/500, 511, 129 R; 40/636
See application file for complete search history.

(56) References Cited

U.S. PATENT DOCUMENTS

| | | | | | |
|---|---|---|---|---|---|
| 613,145 | A | * | 10/1898 | Herrick et al. | 132/273 |
| 1,977,920 | A | * | 10/1934 | Robinson | 132/128 |
| 2,384,013 | A | | 9/1945 | Caldora | |
| 4,327,512 | A | * | 5/1982 | Oliver | 40/636 |
| 5,174,312 | A | * | 12/1992 | Adams | 132/273 |
| 5,735,296 | A | * | 4/1998 | Chen | 132/277 |
| 5,803,096 | A | * | 9/1998 | Lee | 132/277 |
| 5,826,593 | A | * | 10/1998 | Haubrich | 132/128 |
| 5,988,184 | A | * | 11/1999 | Shu | 132/277 |
| 6,047,705 | A | * | 4/2000 | Hawley | 132/128 |
| 6,123,086 | A | * | 9/2000 | Kuglen | 132/275 |
| 6,311,699 | B1 | * | 11/2001 | Horman | 132/278 |
| 6,453,911 | B1 | * | 9/2002 | Silva | 132/275 |
| D483,522 | S | * | 12/2003 | Leslie | D28/33 |
| 6,691,717 | B2 | * | 2/2004 | Silva | 132/275 |

(Continued)

FOREIGN PATENT DOCUMENTS

GB 2 316 001 A 2/1998

(Continued)

*Primary Examiner* — Todd Manahan
*Assistant Examiner* — Vanitha Elgart
(74) *Attorney, Agent, or Firm* — Hovey Williams LLP

(57) ABSTRACT

A hair clip which includes opposing first (12) and second (14) combs, each of which has a body (18) with an upper side (19) and an underside (20), a plurality of spaced apart teeth (21) which extend from the body (18) and a plurality of attachment brackets (22*a*, 22*b*, 22*c*) on the body (18), each of which has an individual recess formation on the underside (20) and at least two spaced apart apertures which extend in the recess formation and between the underside and the upper side, and a biasing member which is attached to the first and second combs (14) and which is engaged with the plurality of attachment brackets (22*a*, 22*b*, 22*c*).

7 Claims, 4 Drawing Sheets

U.S. PATENT DOCUMENTS

| | | | | |
|---|---|---|---|---|
| 6,857,216 | B1 * | 2/2005 | Merin | 43/3 |
| D509,926 | S * | 9/2005 | Gladwin et al. | D28/34 |
| D510,779 | S * | 10/2005 | Gladwin et al. | D28/34 |
| D511,022 | S * | 10/2005 | Gladwin et al. | D28/34 |
| D532,551 | S * | 11/2006 | Kuglen | D28/41 |
| 7,506,653 | B2 * | 3/2009 | Gladwin et al. | 132/128 |
| D597,252 | S * | 7/2009 | Pretorius | D28/32 |
| 7,748,390 | B2 * | 7/2010 | Kuglen | 132/128 |
| 7,753,058 | B2 * | 7/2010 | Chudzik et al. | 132/277 |
| 2005/0268930 | A1 * | 12/2005 | Lane | 132/128 |
| 2006/0219255 | A1 | 10/2006 | Coral et al. | |
| 2007/0012329 | A1 * | 1/2007 | Lane | 132/105 |
| 2010/0108090 | A1 * | 5/2010 | Coral et al. | 132/277 |
| 2010/0132729 | A1 * | 6/2010 | Kuglen et al. | 132/107 |
| 2010/0192967 | A1 * | 8/2010 | Gladwin | 132/126 |

FOREIGN PATENT DOCUMENTS

| | | | |
|---|---|---|---|
| WO | 2004/112532 | A1 | 12/2004 |

* cited by examiner 10
12
28
21
16
14
22C
20
18
22A
22B
16
34

10
12
21
16
18
14
24
20
32
26B
22A
26A

HAIR CLIP

This is a national phase application of International Application PCT/ZA2006/000126 filed 2 Nov. 2006 and claiming priority from South African application serial number 2005/08995 filed 7 Nov. 2005, the disclosures of which are incorporated herein by reference.

BACKGROUND OF THE INVENTION

This invention relates to a hair clip used in the styling and decoration of hair.

A hair clip which consists of two opposing combs and an elastic which is attached to the two combs and which pulls the two combs together in use is known. The elastic often includes intricate beadwork to produce a decorative pattern between the two combs.

The elastic is attached to the respective combs in various ways and sections of the elastic protrude from the underside of the respective combs.

The protruding sections of the elastic are exposed to wear and tear and are easily damaged. This limits the working life of the hair clip.

Additionally the protruding elastic can get caught on a user's hair which might cause damage to the user's hair and discomfort to the user.

The protruding elastics further detract from the aesthetics of the hair clip.

SUMMARY OF THE INVENTION

The invention aims to provide an alternative hair clip and comb used in such hair clip which might alleviate some of the aforementioned problems.

The invention provides a hair clip which includes opposing first and second combs, each of which has a body with an upper side and an underside, a plurality of spaced apart teeth which extend from the body and a plurality of attachment means on the body, each of which has an individual recess formation on the underside and at least two spaced apart apertures which extend in the recess formation and between the underside and the upper side, and a biasing member which is attached to the first and second combs and which is engaged with the plurality of attachment means.

The attachment means may include a bridge formation between the apertures. Preferably the attachment means includes an insert which is engageable with the recess formation. The insert may be press-fitted or adhesively attached to the recess formation. The insert may be cup-shaped in cross-section.

The recess formation may have any shape in plan and can for example have a circular shape in plan.

The attachment means may include three or more apertures and the apertures may be configured in any appropriate pattern such as a semicircular, triangular or square shape.

The biasing member may include a tie member which extends between the first and second combs. The tie member is preferably elastic and passes through the apertures. The biasing member may include ornamentation on the tie member. The ornamentation is preferably in the form of beads of various shapes and sizes. The beads may be arranged on the tie member in a variety of patterns.

The invention also provides a hair clip which includes opposing first and second combs, each of which has a body with an upper side and an underside, a plurality of spaced apart teeth which extend from the body and a plurality of attachment means on the body, each of which has an individual recess formation on the underside, at least two spaced apart apertures which extend in the recess formation and between the underside and the upper side and an insert which is engageable with the recess formation, and a biasing member which is attached to the plurality of attachment means on the first and second combs and which has an elastic tie member which passes through the apertures and ornamentation on the tie member.

The invention further provides a comb for use in a hair clip of the aforementioned kind which has a body with an upper side and an underside, a plurality of spaced apart teeth which extend from the body, and a plurality of attachment means on the body, each of which has an individual recess formation on the underside and at least two spaced apart apertures which extend in the recess formation and between the underside and the upper side.

BRIEF DESCRIPTION OF THE DRAWINGS

The invention is further described by way of an example with reference to the accompanying drawings in which.

DESCRIPTION OF THE PREFERRED EMBODIMENT

Figure 1:
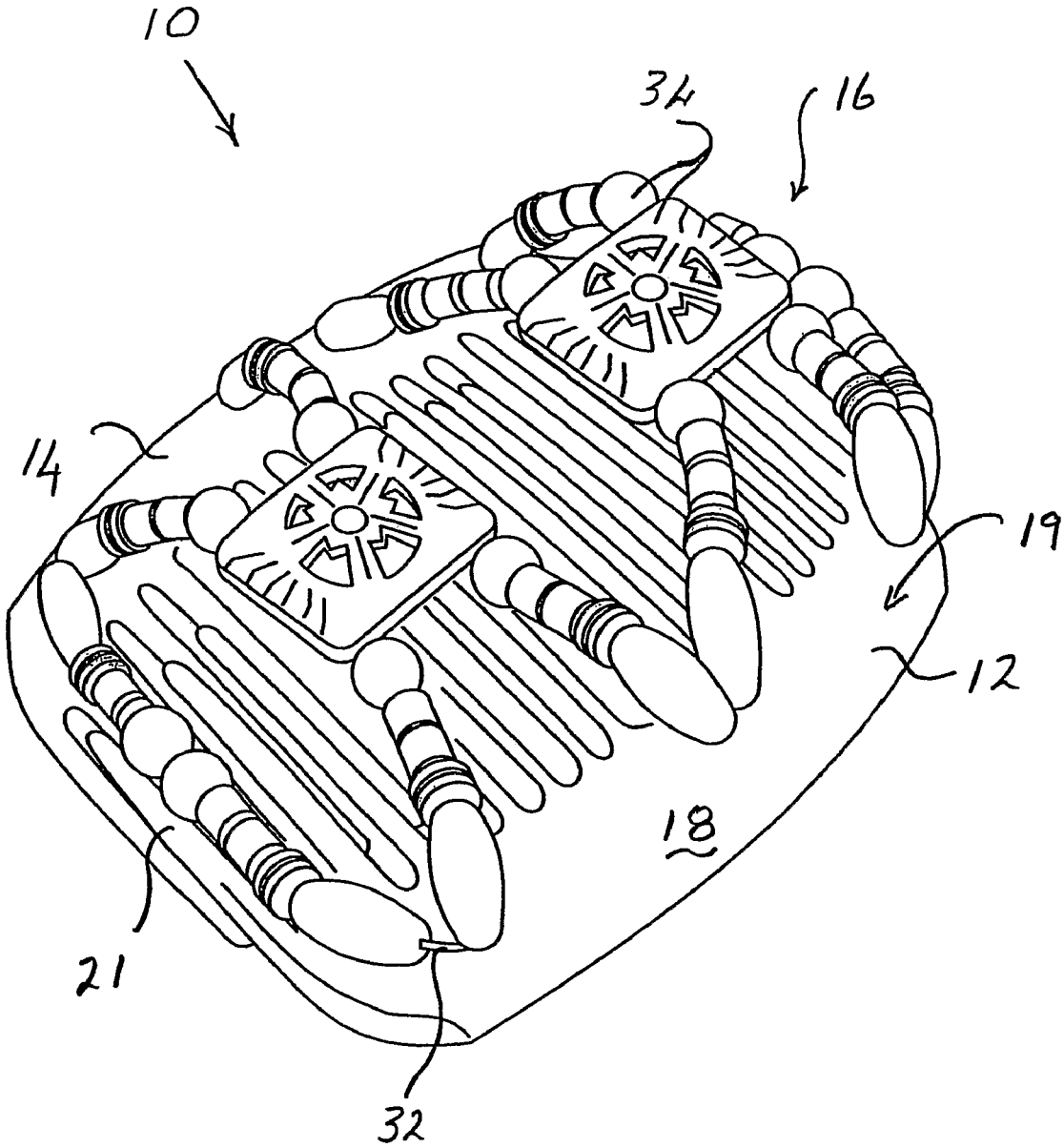
FIG. 1 is a perspective view from above of a hair clip according to the invention in a closed position.
Figure 2:
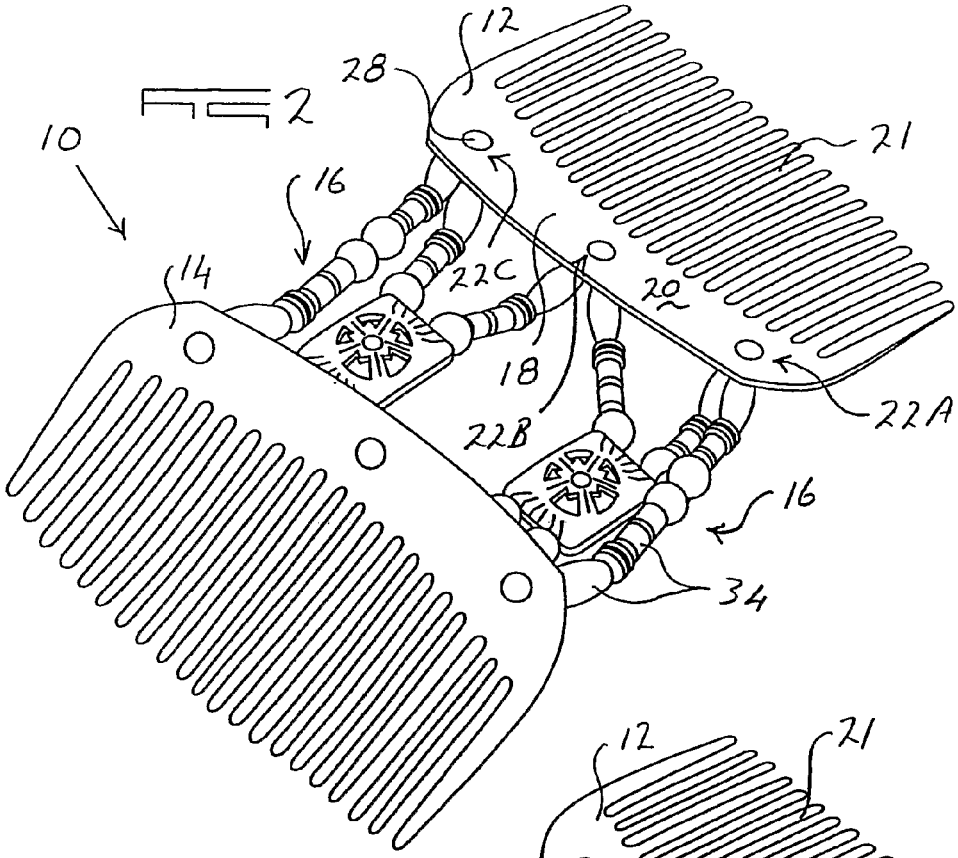
FIG. 2 is a perspective view of an underside of the clip of FIG. 1 in an open position.

FIGS. 1 to 5 show a hair clip 10 which has opposing first and second combs 12, 14 respectively and a biasing member or structure 16 which is attached to, extends between and acts between the first and second combs 12, 14 respectively.

Although the construction of the individual combs 12, 14 can vary identical combs 12, 14 are used in this example and only the first comb 12 is described.

The first comb 12 is made from any appropriate plastics material and is manufactured by way of injection moulding. The first comb 12 has a shoulder body 18 with an upper side 19 and an underside 20 and a plurality of spaced apart teeth 21 which extend from the shoulder 18. The exact shape and configuration of the shoulder 18 and teeth 21 are known and can vary depending on requirements.

A plurality of spaced apart attachment brackets 22A, B, C are formed in the shoulder 18. The exact number of brackets 22 can vary depending on requirements. In this example the brackets 22 are identical and only one bracket 22 is described.

Figure 5:
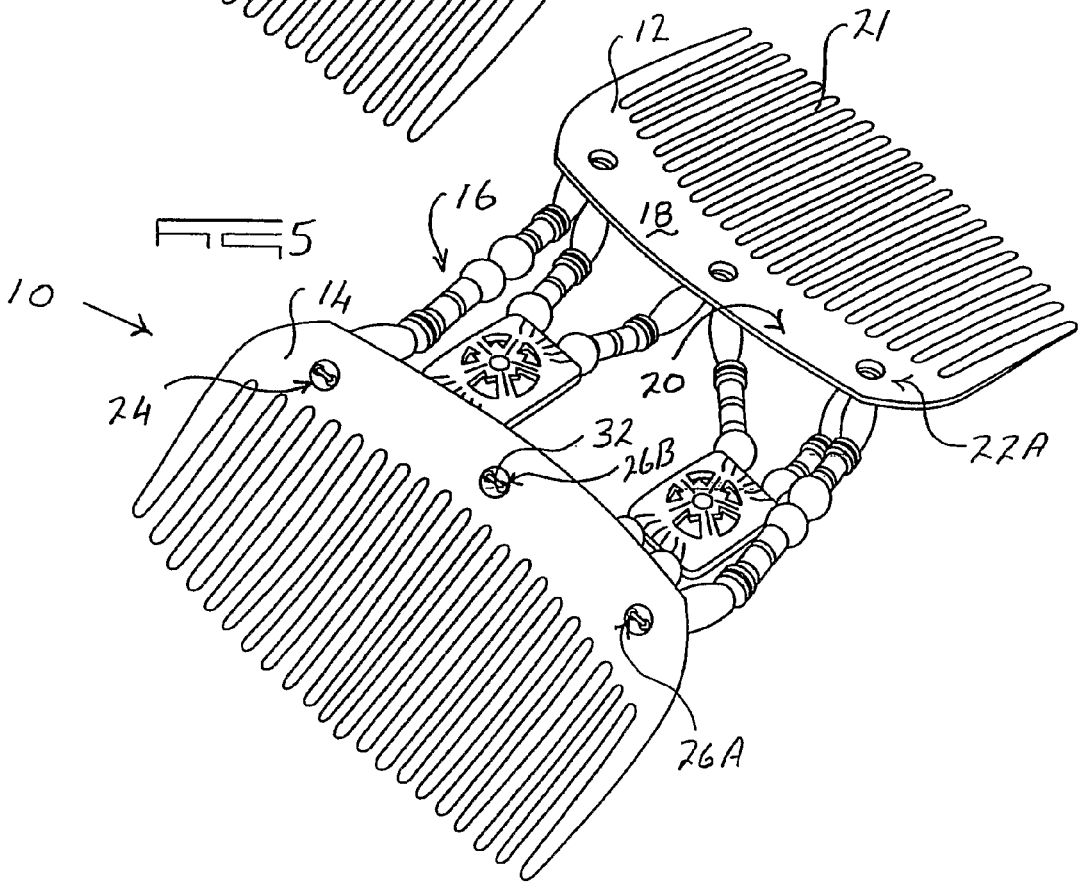
FIG. 5 is a perspective view of the underside of the clip of FIG. 1 in the open position with inserts removed from attachment brackets on opposing combs of the clip.
Figure 4:
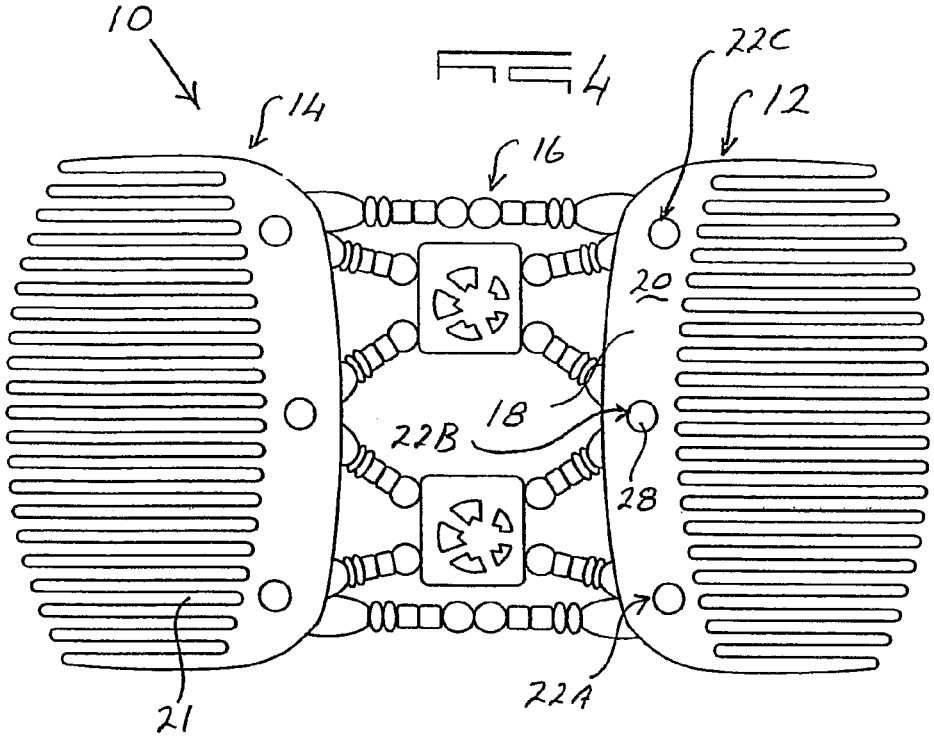
FIG. 4 is a view from below of the clip of FIG. 3.
Figure 3:
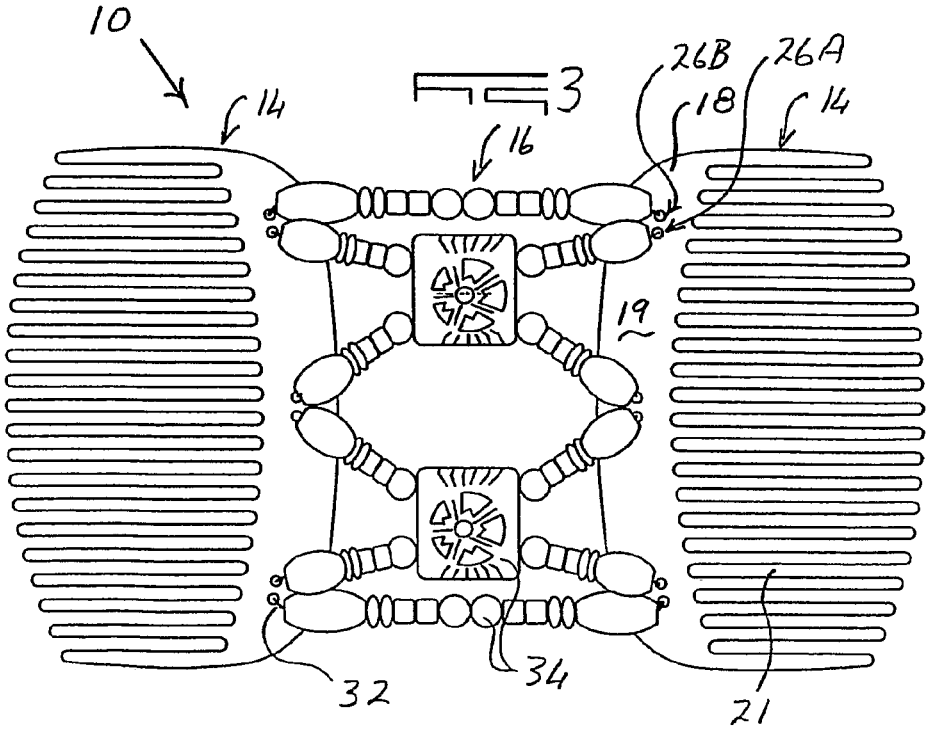
FIG. 3 is a plan view from above of the clip of FIG. 1 in the open position of FIG. 2.
Figure 6:
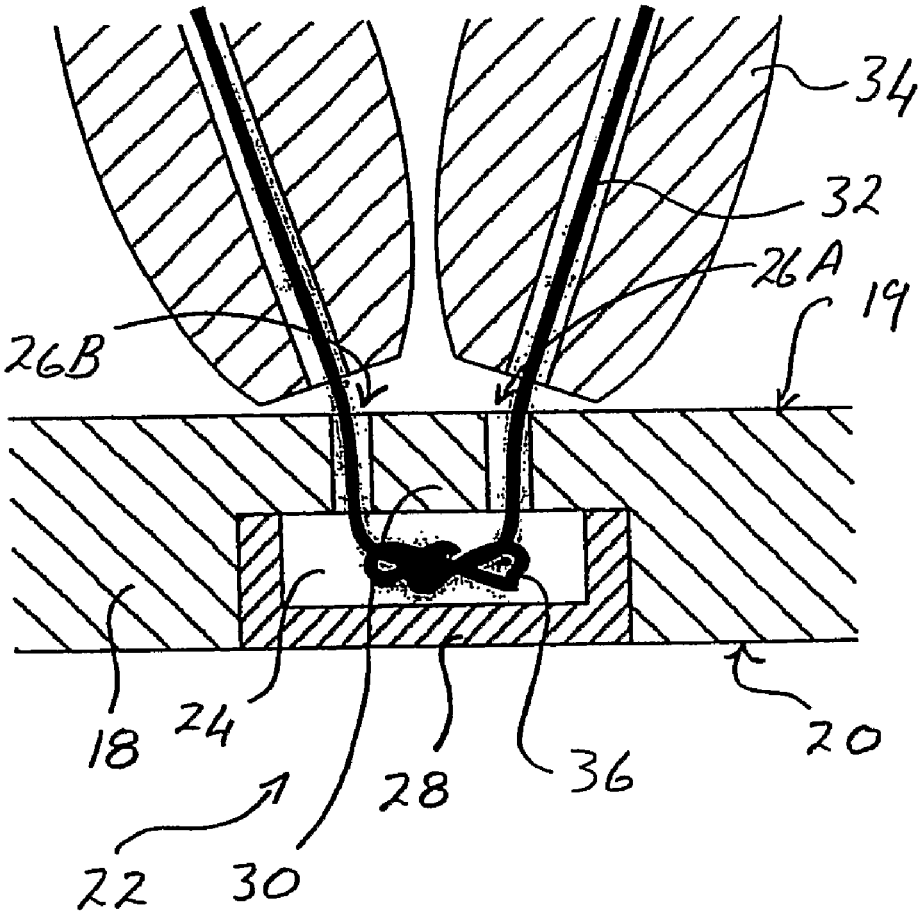
FIG. 6 is a cross-sectional view of an attachment bracket used in the clip of FIG. 1.

As is illustrated in FIGS. 5 and 6 the bracket 22 has a recess 24 in the underside 20 of the shoulder 18 and two spaced apart apertures 26A, B in the recess 24 and which extend through the body 18 between the underside 20 and the upper side 19.

An insert 28 is engageable with the recess 24 and can be press-fitted into the recess 24 or can be glued to the body 18 in the recess 24 by way of any appropriate adhesive.

The insert 28 is also made from any appropriate plastics material through an injection moulding process.

The recess 24 can have any appropriate shape in plan and in this example is circular shaped in plan. Alternatively the recess can be oval, triangular or square shaped in plan.

The number of apertures 26 can also vary but a minimum of two is required to form a bridge 30 between the adjacent apertures 26A, B. For example three or four apertures 26 can be formed in the recess 24 in order to accommodate various weaving patterns of the biasing member 16. The configuration of the apertures 26 can vary and can for example be configured in a semicircle, in a triangle or in a square.

The biasing member can consist of any appropriate elastic member which can pull the first and second combs 12, 14 towards one another in use. In this example the biasing member 16 has an elastic tie 32 which is attached to the first and second combs 12, 14 by way of the brackets 22 and a number of ornamental beads 34 of various shapes and sizes which are trapped on the tie 32. The beads 34 provide ornamentation to the biasing member 16.

By using various weaving patterns, shapes and sizes of beads 34, various techniques and different number and configurations of apertures 26 different shapes and configurations of biasing members 16 can be created.

The tie 32 enters each bracket 22 from the upper side 19 through one of the apertures 26A, passes through the aperture 26A into the recess 24, enters the second aperture 26B at the underside 20, passes through the second aperture 26B and exits the bracket 22 at the upper side 19. The bridge 30 traps the tie 32 on the bracket 22 between the apertures 26. The tie 32 thus forms loops through the apertures 26 and is freely movable through the apertures 26. This feature allows the biasing member 16 to balance itself between the combs 12, 14 to ensure that equal forces are exerted on the combs 12, 14 at each bracket 22.

The ends of the tie 32 are tied in any appropriate way at a joint 36. The joint 36 is located inside a recess 24 and is covered by an insert 28. Alternatively to the joint 36 a knot can be formed in each end of the tie 32 which is larger than the apertures 26. The knot is thus trapped in the recess 24.

As the joint 36 and knots are trapped in the recess 24 and covered by the insert 28 a neat finish of the biasing member 16 and clip 10 is achieved.

Once all inserts 28 are engaged with the recesses 24 the tie 32 does not protrude from the underside 20 and is hidden from view inside the recesses 24. On the upper side 19 the tie 32 is visible where it exits from the apertures 26.

In use the clip 10 is inserted into a user's hair (not shown) in a known manner and grips the hair substantially in the form shown in FIG. 1. The teeth 21 pass through the hair and the shoulder 18 lies on top of the hair with the underside 20 facing towards the hair. The biasing member 16 lies on top of the hair and the upper side 19 faces away from the hair. As the tie 32 is not accessible on the underside 20 the tie 32 is protected from damage on the underside 20 and cannot tangle with the hair on the underside 20.

Depending on finishing the underside 20 of the shoulder 18 can be produced with a smooth and uniform surface which would enhance the aesthetic appeal of the clip 10.

As the joint 36 is trapped in the recess 24 a neat finish of the biasing member 16 is achieved.

As the tie 32 can move freely through at least some of the brackets 22 it is not essential that the various crossovers of the tie 32 between the combs 12, 14 are of equal length. This simplifies manufacturing of the biasing member 16 and the clip 10. Ties 32 of various lengths can be used during manufacturing which allows the design and manufacturing of biasing members 16 of different lengths between the combs 12, 14. In this manner clips 10 designed for different volumes of hair can be made. If required more than one tie 32 can be used to form the biasing member 16.

The invention claimed is:

1. A hair clip which includes opposing first and second combs, each of which has a body with an upper side and an underside, a plurality of spaced apart teeth which extend from the body and a plurality of attachment brackets on the body, each of which attachment brackets includes an individual recess formation on the underside and at least a first aperture and a second aperture extending from the recess formation to the upper side, the first aperture and second aperture being spaced apart from one another to define therebetween a bridge formation, and a biasing member which is attached to the first and second combs, said biasing member including a looped portion positioned within the recess of at least one of the attachment brackets for engagement with a part of the bridge formation located within the recess and first and second running portions which are routed from the recess through the respective first and second apertures thus allowing the biasing means to move freely through each of the apertures.

2. A hair clip according to claim 1 wherein at least one of said attachment brackets includes an insert which is engageable with the recess formation.

3. A hair clip according to claim 2 wherein the insert is press-fitted or adhesively attached to the recess formation.

4. A hair clip according to claim 1 wherein the biasing member includes a tie member which extends between the first and second combs.

5. A hair clip according to claim 4 wherein the tie member is preferably elastic and passes through the apertures.

6. A hair clip according to claim 4 wherein the biasing member includes ornamentation on the tie member.

7. A hair clip according to claim 6 wherein the ornamentation is in the form of beads.

* * * * *